US009615659B2

(12) United States Patent
King

(10) Patent No.: US 9,615,659 B2
(45) Date of Patent: Apr. 11, 2017

(54) GARMENT HANGING SYSTEM

(76) Inventor: Vicki LaRae King, Loveland, CO (US)

( * ) Notice: Subject to any disclaimer, the term of this patent is extended or adjusted under 35 U.S.C. 154(b) by 295 days.

(21) Appl. No.: 13/419,030

(22) Filed: Mar. 13, 2012

(65) Prior Publication Data

US 2013/0240576 A1 Sep. 19, 2013

(51) Int. Cl.

| | |
|---|---|
| ***A47B 61/00*** | (2006.01) |
| ***A47G 25/28*** | (2006.01) |
| ***A47F 5/00*** | (2006.01) |
| *A47G 25/44* | (2006.01) |

(52) U.S. Cl.

CPC ..... *A47B 61/003* (2013.01); *A47F 5/0006* (2013.01); *A47G 25/28* (2013.01); *A47G 25/44* (2013.01)

(58) Field of Classification Search

CPC ..... A47G 25/28; A47G 25/44; A47G 25/06; A47G 25/74; A47G 25/743; A47G 25/746; A47G 29/083; A47G 29/093; A47F 7/19; A47F 5/0876; A47F 5/00; A47F 5/0006; A47B 61/00; A47B 61/003; A47B 61/02

USPC ..... 211/30, 32, 96, 85.3; 248/226.11, 227.1, 248/227.2

See application file for complete search history.

(56) References Cited

U.S. PATENT DOCUMENTS 581,901 A * 5/1897 Cole ..... 24/547
619,379 A * 2/1899 Williams ..... A01G 9/12 24/67.9
1,981,510 A * 11/1934 Jones ..... 312/3
3,240,463 A * 3/1966 Cook ..... 248/339
3,252,583 A * 5/1966 Walther et al. ..... 211/119
3,730,355 A * 5/1973 Feldman ..... 211/59.1
3,799,416 A * 3/1974 Schmaltz ..... 294/142
4,366,909 A * 1/1983 Fahmi ..... A47G 25/18 211/116
4,475,676 A * 10/1984 Smith ..... A45F 5/02 206/315.1
4,607,773 A * 8/1986 Mason ..... 224/546
4,633,918 A * 1/1987 Lachman et al. ..... 140/71 R
4,765,653 A * 8/1988 Fasham ..... B42D 15/0053 206/232
5,094,417 A * 3/1992 Creed ..... 248/215
5,210,973 A * 5/1993 Kratky ..... A01G 9/128 47/44
5,340,071 A * 8/1994 Fox, II ..... B60J 3/0208 224/312
5,480,075 A * 1/1996 Robinson ..... A47G 25/16 211/115
5,489,078 A * 2/1996 Risley ..... B60R 7/05 224/247
5,619,774 A * 4/1997 Perry ..... 24/3.6
5,787,556 A * 8/1998 Terzian ..... A47F 5/0884 24/3.12
5,975,476 A * 11/1999 Mancinelli ..... 248/316.7
D503,430 S * 3/2005 Chang ..... D19/65
(Continued)

*Primary Examiner* — Korie H Chan

(74) *Attorney, Agent, or Firm* — Craig R. Miles; CR MILES P.C.

(57) ABSTRACT

A hanger having a first elongate segment, a second elongate segment, and a third elongate segment disposed in adjacent spaced apart relation, the first elongate segment and the second elongate segment disposed a sufficient distance apart to receive between a thickness of a shelf, the second elongate segment and the third elongate segment disposed a sufficient distance apart to hang a garment on said third elongate member.

15 Claims, 6 Drawing Sheets

(56) References Cited

U.S. PATENT DOCUMENTS

| | | | | |
|---|---|---|---|---|
| 7,464,911 | B1 * | 12/2008 | Yen | 248/304 |
| D600,544 | S * | 9/2009 | Klaus | D8/395 |
| 7,913,958 | B2 * | 3/2011 | MacDuff | F16L 3/1033 165/49 |

* cited by examiner 10
8
3
5
21
9
11
18
19
20
6
7

GARMENT HANGING SYSTEM

I. FIELD OF THE INVENTION

A hanger having a first elongate segment, a second elongate segment, and a third elongate segment disposed in adjacent spaced apart relation, the first elongate segment and the second elongate segment disposed a sufficient distance apart to receive between a thickness of a shelf, the second elongate segment and the third elongate segment disposed a sufficient distance apart to hang a garment on said third elongate member.

II. BACKGROUND OF THE INVENTION

As shown in FIG. 1, many storage areas or closets have one or more shelves (1) which have fixed or adjustable height in relation to a wall (2). Materials such towels or clothing (also referred to as "garments") can be stacked on the shelves (1) but there does not appear to be any device which makes possible or practical hanging materials such as garments from the shelves (1). It would be advantageous to provide a device or a plurality of the devices which can be engaged with the shelves (1) to allow materials to be hung in an orderly fashion.

The instant invention provides a garment hanging system which addresses the need for a device which can be coupled to a shelf to provide a hanger for garments.

III. SUMMARY OF THE INVENTION

A broad object of the invention can be to provide a hanger having a first elongate segment, a second elongate segment, and a third elongate segment disposed in adjacent spaced apart relation, the first elongate segment and the second elongate segment disposed a sufficient distance apart to receive between a thickness of a shelf, the second elongate segment and the third elongate segment disposed a sufficient distance apart to hang a garment on said third elongate member.

Another broad object of the invention can be to provide a hanger having a first elongate segment and a second elongate segment disposed in adjacent angled spaced apart relation by a crosspiece which joins first ends of the first and second elongate segments. The crosspiece can allow sufficient resilient flexure of the first elongate segment in relation to the second elongate segment to receive a shelf between said first and second elongate segment in the flexed condition and to return sufficiently toward the unflexed condition to forcibly engage the surface of the shelf.

Another broad object of the invention can be to provide a hanger having a telescoping member which can be extended and retracted depending upon the size of the garment to be hung.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
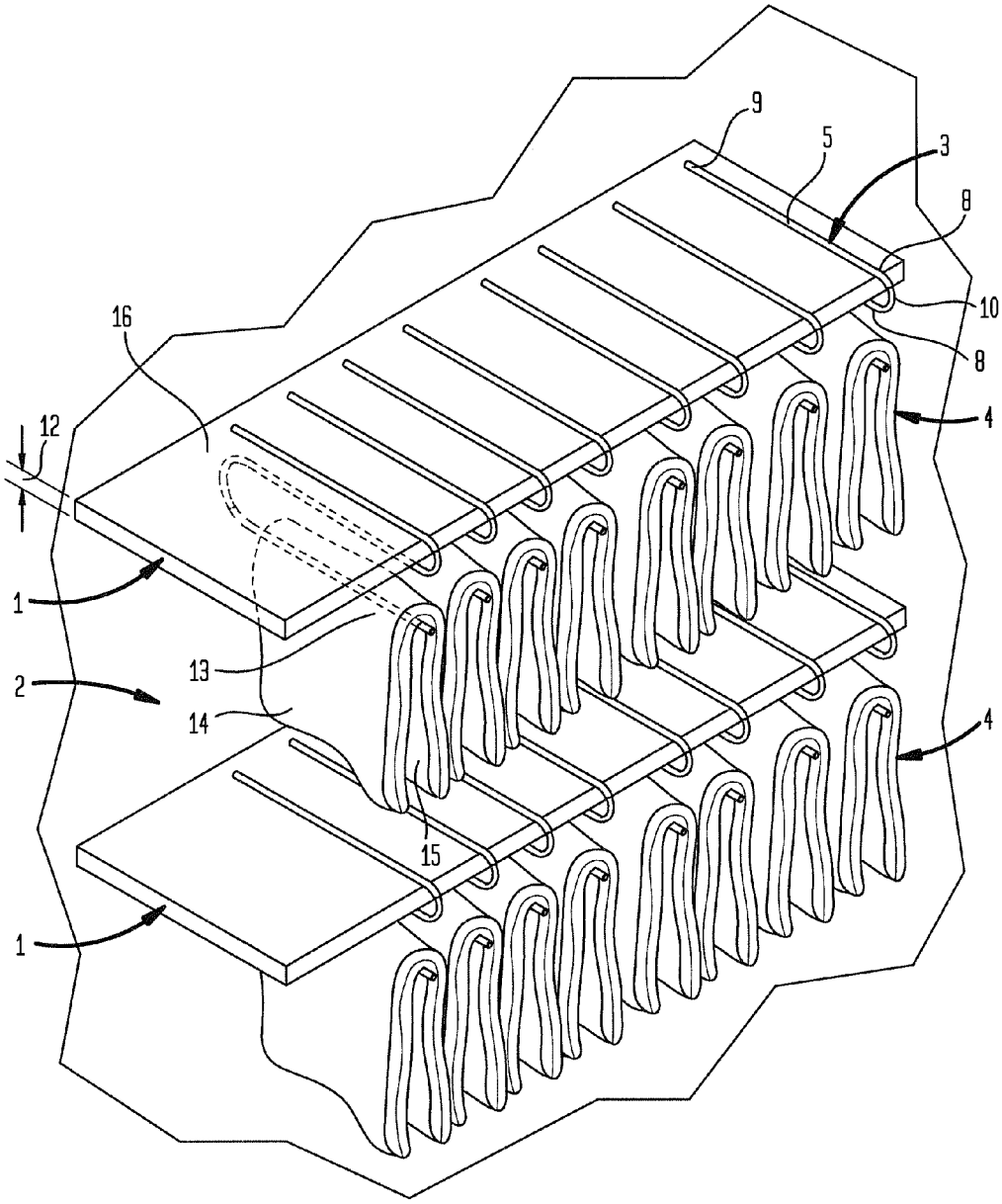
FIG. 1 is an illustration of a method of using a particular embodiment of the inventive hanger which receives a part of a shelf between a first and second elongate member and receives a garment between the second and a third elongate member.
Figure 2:
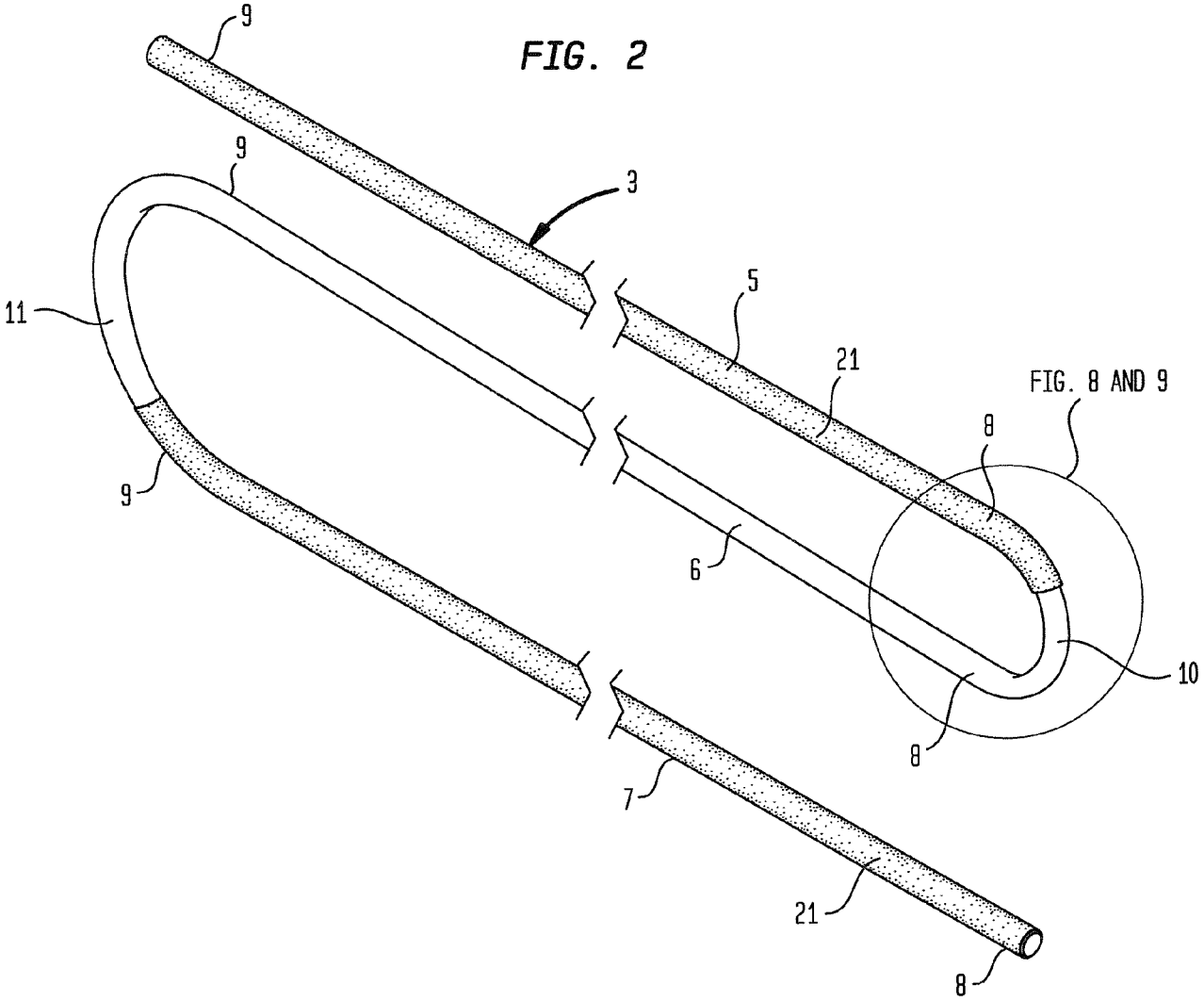
FIG. 2 is perspective view a particular embodiment of the inventive hanger.

Now referring primarily to FIGS. 1 and 2, which illustrates a method of using the inventive hanger (3) for the purpose of hanging a garment (4). Embodiments of the hanger (3) include a first elongate segment (5), a second elongate segment (6), and a third elongate segment (7) with each of the elongate segments (5)(6)(7) having a length disposed between a first end (8) and a second end (9). The elongate segments (5)(6)(7) can be disposed in adjacent spaced apart relation. A first crosspiece (10) can be coupled between the first ends (8) of the first elongate segment (5) and the second elongate segment (6) to maintain the spaced apart relation. A second crosspiece (11) can be coupled between the second ends (9) of the second elongate segment (6) and the third elongate segment (7) to maintain the spaced apart relation. The spaced apart relation of the first elongate segment (5) in relation to the second elongate segment (6) sufficient to receive between a thickness (12) of one of the shelves (1). The spaced apart relation of the second elongate segment (6) and the third elongate segment (7) sufficient to receive between a garment (4).

Again referring primarily to FIG. 1, by obtaining an embodiment of the inventive hanger (3), a user can locate the garment (4) between the second elongate segment (6) and the third elongate segment (7). As shown in FIG. 1, the third elongate segment (7) can engage a medial portion (13) of the garment (4) allowing the respective end portions (14)(15) of the garment (4) to hang downwardly from the third elongate member (7). The user can then position the first elongate segment (5) and the second elongate segment (6) to receive between a part of one of the shelves (1). The user can then engage the first elongate member (5) with a top surface (16) of a shelf (1) to suspend the garment (4) in relation to the shelf (1).

Figure 10:
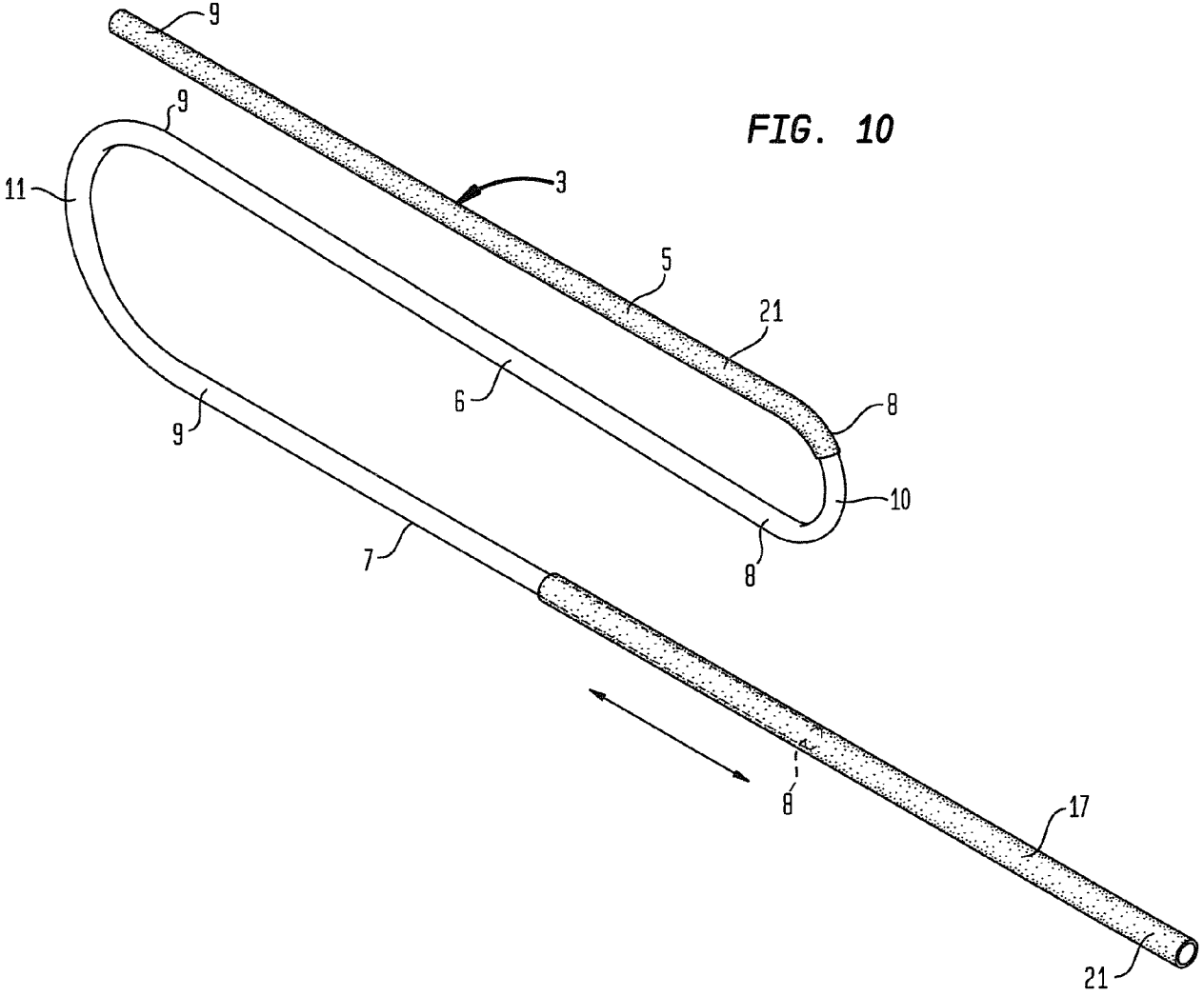
FIG. 10 is a perspective view of a particular embodiment of the inventive hanger having a telescoping segment which telescopically engages said first elongate segment or said second elongate segment.
Figure 11:
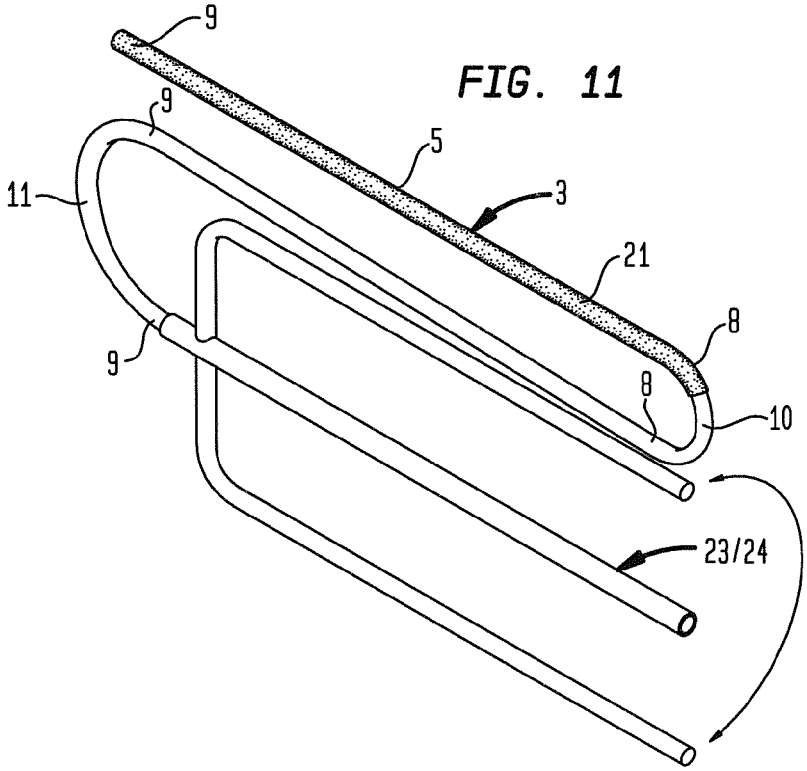
FIG. 11 is a perspective view of a particular embodiment of the inventive hanger having a furcated member rotationally engaged to a third elongate segment.
Figure 12:
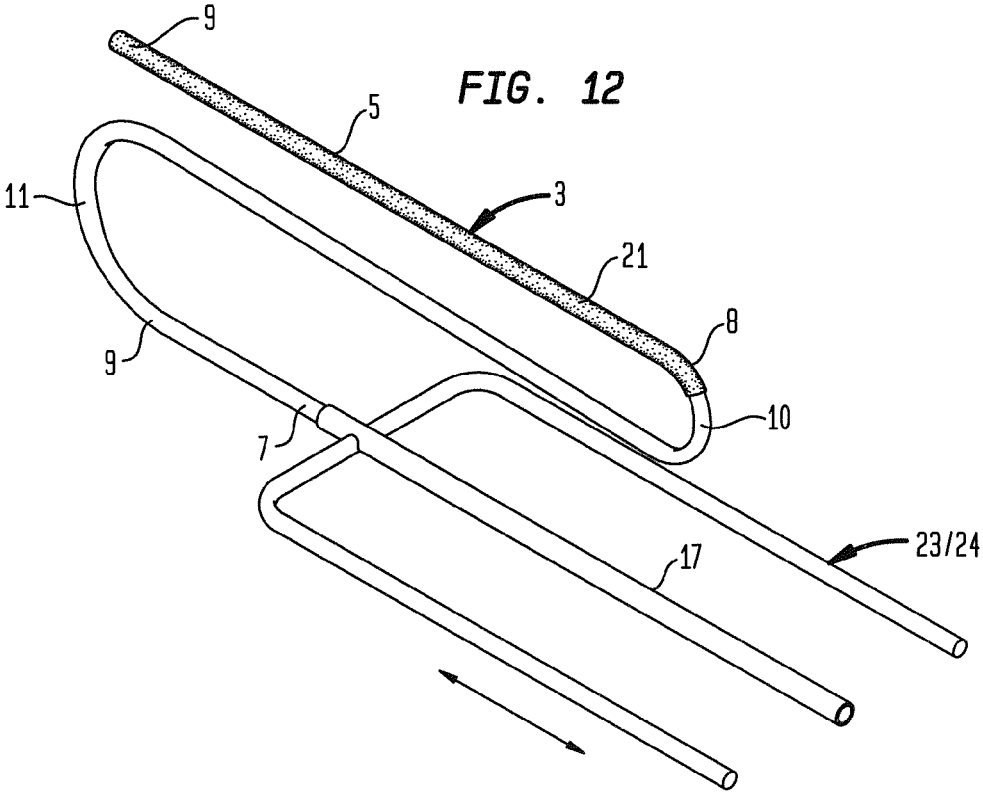
FIG. 12 is a perspective view of a particular embodiment of the inventive hanger having a furcated member telescopically engaged to a third elongate segment.

Now referring primarily to FIGS. 10-12, the method of hanging a garment (4) can further include extending a telescoping segment (17) telescopically engaged to the first elongate segment (5) or to the second elongate segment (6). In the extended condition, the user can engage a medial portion (13) of the garment (4) allowing the respective end portions (14)(15) of the garment (4) to hang downwardly from the telescoping segment (17), as above described.

For the purposes of this invention to term "garment" means any material in any configuration that can engaged with an elongate member (7) and as examples: towels (18) as shown in the example of FIG. 1, pants, shirts, T-shirts, sweat shirts, ties, dresses, skirts, hosiery, tights, leggings, or the like.

For the purposes of this invention the term "shelves" or "shelf" means any fixed object, including as one example conventional shelves (1) as shown in FIG. 1, which can be received between the first elongate segment (5) and the second elongate segment (6) to support the inventive hanger (3) in relation to the fixed object.

Now referring primarily to FIGS. 2 through 7, which show a particular embodiment of the inventive hanger (3). Embodiments of the inventive hanger (3) include a first elongate segment (5), a second elongate segment (6), and a third elongate segment (7) disposed in adjacent spaced apart relation with each elongate segment (5)(6)(7) having a length (18) disposed between a first end (8) and a second end (9). Each of the elongate segments (5)(6)(7) can have a generally linear cylindrical form as shown in the example of FIGS. 2 through 7. Particular embodiments of the elongate segments (5)(6)(7) can have a generally linear cylindrical configuration having circular cross section. Certain embodiments of the linear cylindrical configuration can be in the form of cylindrical rod having a diameter in the range of about one-eighth inch to about three-eighths inch and specifically embodiments can be formed from cylindrical rod of about one-quarter inch. While the length of each of the elongate segments (5)(6)(7) can depend upon the application, particular embodiments of the elongate segments (5)(6)(7) can have a length in the range of about six inches to about fifteen inches with particular embodiments having a length of about ten inches. However, the above description is not intended to be limiting with respect to numerous and varied configurations of the elongate segments (5)(6)(7) which can be in the form of curved elongate segments, linear elongate segments, undulated elongate segments, or the like useful in engaging a shelf (1) as above described or in engaging a garment (4), as above described. Additionally, the elongate segments (5)(6)(7) can be either solid or tubular and can in cross section be circular, oval, square, triangular, rectangular, or the like.

Figures 3, 4, 5:
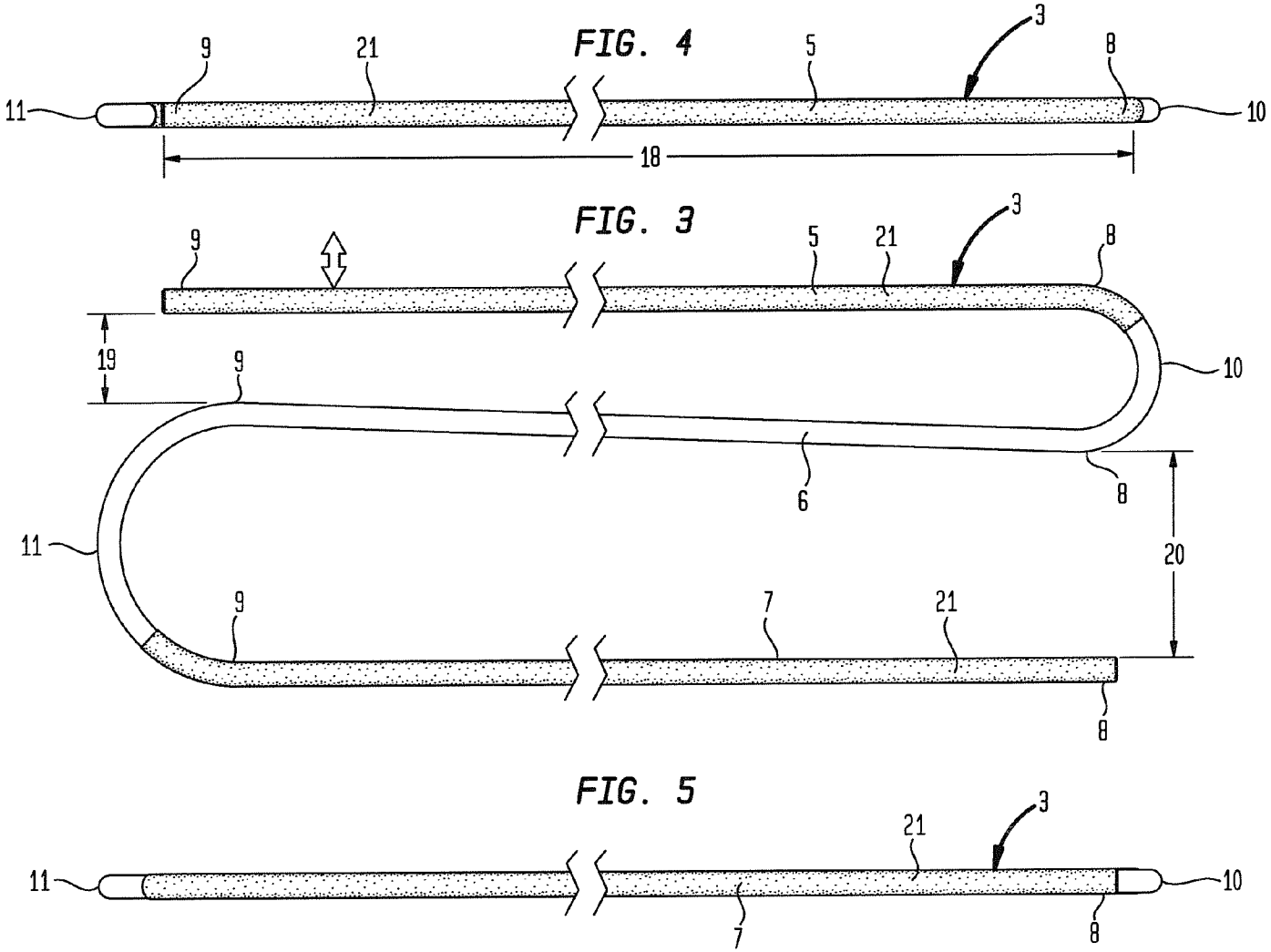
FIG. 3 is a side view of a particular embodiment of the inventive hanger.
FIG. 4 is a top view of a particular embodiment of the inventive hanger.
FIG. 5 is a bottom view of a particular embodiment of the inventive hanger.
Figure 6:
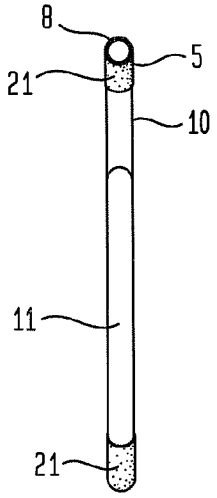
FIG. 6 is a first end view of a particular embodiment of the inventive hanger.
Figure 7:
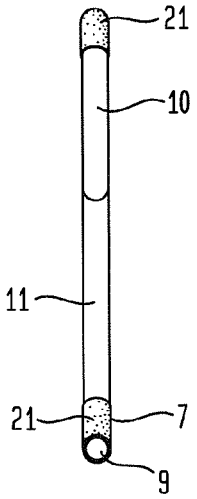
FIG. 7 is a second end view of a particular embodiment of the inventive hanger.

Now referring primarily to FIGS. 2 and 3, a first crosspiece (10) can be coupled between the first ends (8) of the first elongate segment (5) and the second elongate segment (6) to maintain a distance (19) between said first elongate segment (5) and the second elongate segment (6). A second crosspiece (11) can be coupled between the second ends (9) of the second elongate segment (6) and the third elongate segment (7) to maintain a distance (20) between the second elongate segment (6) and the third elongate segment (7). The distance (20) between the first elongate segment (5) and the second elongate segment (6) depends upon the application, the distance being sufficient as to particular embodiments to allow a shelf (1) to be received between the first elongate segment (5) and the second elongate segment (6). As to particular embodiments, the distance (19) between the first elongate segment (5) and the second elongate segment (6) can be in the range of about two inches and four inches with particular embodiments defining a distance (19) of about two and one-half inches.

A distance (20) between the second elongate segment (6) and the third elongate segment (7) depends upon the application, the distance (20) being sufficient as to particular embodiments to allow a garment (4) to be received between the second elongate segment (6) and the third elongate segment (7). As to particular embodiments, the distance (20) between the second elongate segment (6) and the third elongate segment (7) can be in the range of about one inches and four inches with particular embodiments defining a distance (20) of about one and one-half inches.

Now referring primarily to FIG. 3, as to particular embodiments, the first crosspiece (10) and the second crosspiece (11) can maintain the distance (19) between the first elongate segment (5) and the second elongate segment (6) and between the second elongate segment (6) and the third elongate segment (7), in generally parallel spaced apart relation. As to other embodiments, the first elongate segment (5) or the third elongate segment (7), or both, can be maintained in angled spaced apart relation to the second elongate segment (6). As shown in the example of FIG. 3, the first crosspiece (10) maintains the first elongate segment (5) in angle spaced apart relation to the second elongate segment (6) with the first elongate segment (5) having lesser distance (19) in relation to the second elongate segment (6) approaching the second end (9) of the first elongate segment (5). Also, as shown in the example of FIG. 3, the second crosspiece (11) maintains the third elongate segment (7) in generally parallel relation to said second elongate segment (6). As to particular embodiments, the first elongate segment (5) can have an amount of flexure in relation to the second elongate segment (6) which allows the first elongate segment (5) to be forcibly urged against the surface of the shelf (1) when received between the first elongate segment (5) and the second elongate segment (6).

Figure 8:
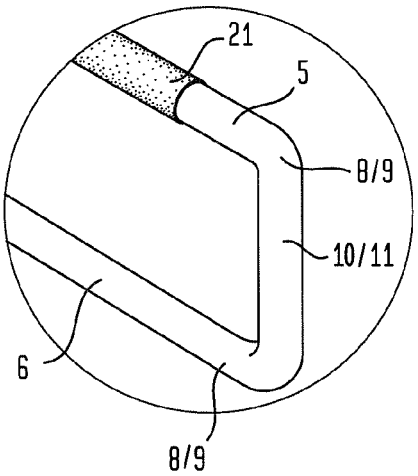
FIG. 8 is perspective first end view of a particular configuration of a first cross piece being generally linear which maintains a first elongate segment and a second elongate segment in spaced apart relation.
Figure 9:
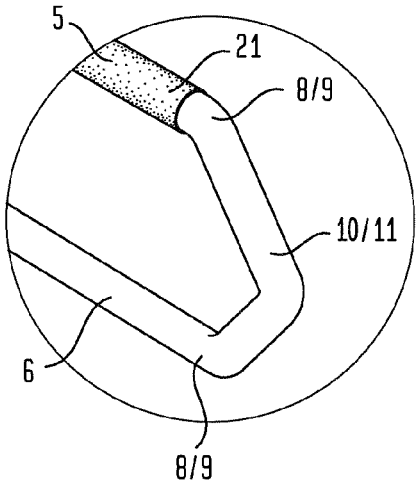
FIG. 9 is perspective first end view of a particular configuration of a first cross piece being angled which maintains a first elongate segment and a second elongate segment in spaced apart relation.

Now referring primarily to FIGS. 3, 8 and 9, embodiments of the first crosspiece (10) and the second crosspiece (11) can be arcuate as shown in the example of FIG. 3, generally linear as shown in the example of FIG. 8, or angled as shown in the example of FIG. 9, or combinations thereof; however, embodiments of the first crosspiece (10) and the second crosspiece (11) can be of any configuration which maintains the first elongate segment (5) and the third elongate segment (7) in adjacent spaced apart relation to the second elongate segment (6).

Embodiments of first elongate segment (5), the second elongate segment (6), and the third elongate segment (7) along with the first crosspiece (10) and the second crosspiece (11) can be produced from a wide variety of materials such as metal, stainless steel, plastic whether as one piece as shown in the examples of FIGS. 2 through 6 or from a plurality of joined or coupled pieces.

Again referring primarily to FIGS. 2 through 5, embodiments of the inventive hanger (3) can further include a cover (21) coupled to the first elongate segment (5) or the third elongate segment (7), or both. Embodiments of the cover (21) can be produced from a wide range of different materials for example a foam, an elastomer, a thermoplastic elastomer, a polyvinyl chloride, a rubber, or the like, or combinations thereof. Depending upon the embodiment, the cover can be applied as a sleeve, coated by brushing, spraying, dipping, or the like.

Now referring to FIG. 10, embodiments of the inventive hanger (3) can further include one or more a telescoping segments (17) which correspondingly slidely engages either one or both of the first elongate segment (5) or the second elongate segment (6). While shown in the example of FIG. 10 as a tubular member circular in cross section which slidely engages about a tubular or solid elongate segment (5)(7), embodiments can include any useful telescoping pairing of an elongate segment (5)(7) and a telescoping segment (17).

Now referring primarily to FIGS. 11 and 12, embodiments of the inventive hanger (3) can further include a furcated member (23) whether a trifurcated member (24) as shown in the examples of FIGS. 11 and 12 or bifurcated, quadfurcated, pentafurcated, or the like. The configuration of the furcated member (23) can allow the furcated member (23) to rotate in relation to the third elongate segment (7) as shown in the example of FIG. 11 or allow telescoping engagement as shown in the example of FIG. 12.

As can be easily understood from the foregoing, the basic concepts of the present invention may be embodied in a variety of ways. The invention involves numerous and varied embodiments of an inventive passive chamber spark plug including devices and methods for using such devices including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "hanger" should be understood to encompass disclosure of the act of "hanging"—whether explicitly discussed or not—and, conversely, were there effectively disclosure of the act of "hanging", such a disclosure should be understood to encompass disclosure of a "hanger" and even a "means for hanger." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the hangers herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

The invention claimed is:

1. A hanger for a garment, comprising:

a) a first linear elongate segment, a second linear elongate segment, and a third linear elongate segment disposed in adjacent spaced apart substantially coplanar relation, each said linear elongate segment having a substantially similar length disposed between a first end and a second end;

b) a first crosspiece coupled between said first ends of said first linear elongate segment and said second linear elongate segment to dispose said first linear elongate segment in angled spaced apart relation to said second linear elongate segment, said first crosspiece further maintaining sufficient distance between said first linear elongate segment and said second linear elongate segment to receive a thickness of a shelf;

c) a second crosspiece coupled between said second ends of said second linear elongate segment and said third linear elongate segment to dispose said third linear elongate segment in angled spaced apart relation to said second linear elongate segment, said second crosspiece further maintaining sufficient distance between said second linear elongate segment and said third linear elongate segment to receive said garment; and d) a furcated member engaged with said third linear elongate segment;

e) wherein a distance between said second ends of said first and second linear elongate segments is lesser than a distance between said first ends of said first and second linear elongate segments; and f) wherein a distance between said first ends of said second and third linear elongate segments is lesser than a distance between said second ends of said second and third linear elongate segments.

2. The hanger of claim 1, wherein said furcated member is rotationally engaged with said third linear elongate segment.

3. The hanger of claim 1, wherein said furcated member is telescopically engaged with said third linear elongate segment.

4. The hanger of claim 1, wherein said furcated member is a trifurcated member.

5. The hanger of claim 1, further comprising a telescoping segment which telescopically engages with one of said first, second, and third linear elongate segments.

6. The hanger of claim 1, further comprising a cover which at least a partially covers one of said first, second, and third linear elongate segments.

7. The hanger of claim 6, wherein said cover is selected from the group consisting of: foam, elastomer, thermoplastic elastomer, rubber, and combinations thereof.

8. A method of producing a hanger for a garment, comprising:

a) disposing a first linear elongate segment, a second linear elongate segment, and a third linear elongate segment in adjacent spaced apart substantially coplanar relation, each said linear elongate segment having a substantially similar length disposed between a first end and a second end;

b) coupling a first crosspiece between said first ends of said first linear elongate segment and said second linear elongate segment to dispose said first linear elongate segment in angled spaced apart relation to said second linear elongate segment, said first crosspiece further maintaining sufficient distance between said first linear elongate segment and said second linear elongate segment to receive a thickness of a shelf;

c) coupling a second crosspiece between said second ends of said second linear elongate segment and said third linear elongate segment to dispose said third linear elongate segment in angled spaced apart relation to said second linear elongate segment, said second crosspiece further maintaining sufficient distance between said second linear elongate segment and said third linear elongate segment to receive said garment; and d) engaging a furcated member with said third linear elongate segment;

e) wherein a distance between said second ends of said first and second linear elongate segments is lesser than a distance between said first ends of said first and second linear elongate segments; and f) wherein a distance between said first ends of said second and third linear elongate segments is lesser than a distance between said second ends of said second and third linear elongate segments.

9. The method of claim 8, further comprising rotationally engaging said furcated member with said third linear elongate segment.

10. The method of claim 8, further comprising telescopically engaging said furcated member with said third linear elongate segment.

11. The method of claim 8, further comprising providing said furcated member as a trifurcated member.

12. The method of claim 8, further comprising telescopically engaging a telescoping segment with one of said first, second, and third linear elongate segments.

13. The method of claim 8, further comprising at least a partially covering one of said first, second, and third linear elongate segments with a cover.

14. The method of claim 13, further comprising selecting said cover from the group consisting of: foam, elastomer, thermoplastic elastomer, rubber, and combinations thereof.

15. A method of hanging a garment on a hanger, comprising:

a) obtaining said hanger comprising:

i) a first linear elongate segment, a second linear elongate segment, and a third linear elongate segment disposed in adjacent spaced apart substantially coplanar relation, each said linear elongate segment having a substantially similar length disposed between a first end and a second end;

ii) a first crosspiece coupled between said first ends of said first linear elongate segment and said second linear elongate segment to dispose said first linear elongate segment in angled spaced apart relation to said second linear elongate segment, said first crosspiece further maintaining sufficient distance between said first linear elongate segment and said second linear elongate segment to receive a thickness of a shelf;

iii) a second crosspiece coupled between said second ends of said second linear elongate segment and said third linear elongate segment to dispose said third linear elongate segment in angled spaced apart relation to said second linear elongate segment, said second crosspiece further maintaining sufficient distance between said second linear elongate segment and said third linear elongate segment to receive said garment; and iv) a furcated member engaged with said third linear elongate segment;

v) wherein a distance between said second ends of said first and second linear elongate segments is lesser than a distance between said first ends of said first and second linear elongate segments; and vi) wherein a distance between said first ends of said second and third linear elongate segments is lesser than a distance between said second ends of said second and third linear elongate segments;

b) engaging said first linear elongate segment with a top surface of said shelf; and c) engaging said garment with said furcated member.

* * * * *